United States Patent [19]

Derner et al.

[11] 4,416,101

[45] Nov. 22, 1983

[54] INSULATING GLASS WINDOW STRUCTURE

[75] Inventors: Paul Derner, Gelsenkirchen; Dietrich Mertin, Witten, both of Fed. Rep. of Germany

[73] Assignee: BFG GLASSGROUP, Paris, France

[21] Appl. No.: 253,297

[22] Filed: Apr. 13, 1981

[30] Foreign Application Priority Data

Apr. 14, 1980 [DE] Fed. Rep. of Germany ..... 3014207

[51] Int. Cl.[3] ..... E04C 1/42

[52] U.S. Cl. ..... 52/398; 52/308; 52/788

[58] Field of Search ..... 52/171, 172, 306–308, 52/788–791, 202, 203, 398–400, 403

[56] References Cited

U.S. PATENT DOCUMENTS

| | | | |
|---|---|---|---|
| 2,934,801 | 5/1960 | Blaszkowski | 52/399 |
| 3,054,153 | 9/1962 | Partsch | 52/788 |
| 3,824,753 | 7/1974 | Andersonn | 52/203 |
| 3,971,178 | 7/1976 | Mazzoni et al. | 52/202 |
| 4,208,849 | 6/1980 | Lamb | 52/203 |

FOREIGN PATENT DOCUMENTS

| | | | |
|---|---|---|---|
| 953159 | 8/1974 | Canada | 52/790 |
| 31 | 12/1978 | European Pat. Off. | 52/788 |
| 1297594 | 6/1960 | France | 52/399 |

*Primary Examiner*—James L. Ridgill, Jr.
*Attorney, Agent, or Firm*—Karl F. Ross; Herbert Dubno

[57] ABSTRACT

An insulating window structure has an inner glass pane spaced from an outer glass pane by a spacer frame extending around the panes so that the panes define between them, within the frame, a gas-filled space. According to the invention, at least one of the panes is anchored to the frame by a resilient connecting unit having a spring characteristic (restoring force plotted along the ordinate versus displacement plotted along the abscissa) which has a substantially horizontal portion at the center of this characteristic and at which the working point of the resilient unit is provided.

6 Claims, 7 Drawing Figures

INSULATING GLASS WINDOW STRUCTURE

FIELD OF THE INVENTION

Our present invention relates to an insulating window structure with improved acoustic damping and, more particularly, to a window structure of the type in which an inner glass pane and an outer glass pane are held in spaced-apart relationship via a frame extending around the panes and defining therewith a gas-filled space.

BACKGROUND OF THE INVENTION

Insulating window structures of the double-pane type generally comprise a frame surrounding a pair of glass panes which are spaced apart by the frame structure so as to define a gas-filled space between them.

This structure includes an inner pane, an outer pane as well as the spacing frame and can also include a resilient means for mounting, supporting and engaging at least one of these panes to enable relative displacement of this pane with respect to the other pane and the frame to a limited degree.

As is the case with all resilient or spring structures, the resilient means has a spring characteristic, i.e. a restoring force which is a function of its displacement, the resilient characteristic being expressed generally in terms of a characteristic curve (hereinafter spring force or restoring force characteristic) plotted on a graph whose ordinate represents the restoring force, spring force or pressure, while the abscissa represents the displacement or the resilient means.

As applied to the resilient means which can be utilized to retain a glass pane in the frame, the spring characteristic can be a plot of pressure applied by the resilient means to the spring-supported pane (along the ordinate) versus displacement of the resilient means by the movement of the pane along the abscissa.

The force supplied to the movable pane or, when both panes are movable, to the movable panes, thus represents a function of the resistance generated by the or each resilient means upon the displacement of the panes. This relative displacement of the panes can be toward or away from one another and can result from pressure changes such as a change in ambient or atmospheric pressure, or the effect of a sound field upon the window structure.

Either the inner glass pane or the outer glass pane, or both can be formed, in turn, of a number of glass sheets in a spaced-apart relationship and with gas-filled or evacuated spaces between them. Although each pane will be referred to in the singular herein, it should be understood that either or both of them may be compound panes made up of two or more glass sheets in the manner described.

German patent document No. 25 26 438 describes a window structure in which the resilient means is formed from a profile rubber strip which has a spring and a working point, i.e. the point along this curve with which the strip supports the movable glass pane at rest, i.e. the standard pressure in the absence of the sound field.

This characteristic and the working point are such that even with slight displacements of the movable pane by the effects described above, relatively large restoring forces are applied to the edges of the movable glass pane, particularly along the edge zones engaged by the resilient means.

Of course, with the conventional system described it is possible to reduce the restoring force with small displacements but only at the expense of "softening" the mounting of the movable pane, i.e. failing to generate a sufficient restoring force in the case of relatively large displacement of the pane.

We have found that because of this defect in the conventional systems, a window structure constituted as described has relatively little acoustic damping effect, i.e. does not materially damp or attenuate sound energy impinging upon one of the panes so that a considerable part of this energy is transmitted through the window structure to the other pane and thence into the region in which this latter pane is exposed.

In practice it is found that the spring characteristic in the region of the working point is so steep (stiff spring characteristic) that it cannot contribute more than two decibels (dB) to the damping effect. In addition, the window structure is highly susceptible to alteration of the resilient structure because of aging and hence to changes in the acoustic damping and other properties of the window.

OBJECTS OF THE INVENTION

It is, therefore, the principal object of the present invention to provide a window structure which is less sensitive to aging and/or has improved sound damping properties and hence has greater long term reliability than earlier systems.

Yet another object of the invention is to provide a window structure which is free from the drawbacks of the earlier systems described and others.

SUMMARY OF THE INVENTION

These objects and others which will become apparent hereinafter are attained in accordance with the present invention in a window structure comprising an inner glass pane and an outer glass pane and spacer means extending around the peripheries of said panes and including a frame for holding said panes in spaced-apart relationship so that said panes define a gas-filled space between them, at least one of the panes being held movably on said frame by resilient means whose spring or restoring force characteristic, in a plot of force along the ordinate against displacement along the abscissa, has a horizontal section substantially centrally of the characteristic and at which the working point of the resilient means is located at least in the normal position of the movable pane. Preferably, this working point lies at the center of the horizontal section of the characteristic curve.

With the resilient means so constructed and arranged, a small displacement of the movable pane will result in shifts of the working point along the horizontal section in either direction, i.e. with a minimum of spring resistance whereas large displacements of the movable pane in either direction will counter sharply increased resistance by the elastic means.

The resilient means engaging the periphery or edge zone of the movable pane thus is formed by spring means with nonlinear spring characteristic and preferably by at least oppositely acting spring elements each having a nonlinear characteristic.

The small displacements of the pane can generate restoring forces in the springs which are extremely low by comparison to the bending resistance or flexual stiffness of the movable pane itself. Large displacements, however, result in a sharp increase in the spring force.

It has been found to be advantageous to so dimension the resilient means that the sharp increase in the restoring force occurs with displacement of the movable panes through distances more than 5% of the interpane spacing and preferably no larger than 12% of the interpane spacing with the restoring force at the latter displacement limit being approximately equal to the force necessary to deform the glass pane.

It has been found to be advantageous, for most effective sound damping, to provide a spring characteristic such that the force developed with a 5% displacement of the movable plane, with respect to the interpane spacing, is less than 15% (preferably less than 5%) of the force which results from 10% displacement. With a 5% displacement the force applied to the edge should be less than 1% of the force resulting from a 10% displacement for optimum acoustic damping.

The spring elements themselves can be provided in various embodiments, e.g. as precompressed leaf springs, plate or disk springs or resilient elastomeric strips or elements. Especially effective results are obtained when the spring members are open-port, soft-elastic materials since these can easily be provided with a spring characteristic of the desired form.

According to a feature of the invention, the edge of the glass pane is received in or mounted on a mounting profile connected to a forming part of the spacer frame.

The spring means can comprise two spring strips which are of bulging cross section and have convex or concave sides (preferably convex sides) turned toward and acting upon the movable panes and the opposite sides turned toward and acting upon rigid members forming part of the spacer frame.

With the system of the present invention, any spring arrangement permitting displacement of the movable pane can have its sound damping effect increased by 5 dB simply by utilizing the spring characteristic and operating points framed to above.

According to another feature of the invention, the window structure has an interpane spacing which is increased for decreasing total glass thickness and vice versa the space being filled with a glass in which speed and sound is at least 10% less than that in air or at least 20% greater than that of air. The interpane spacing for a total glass thickness of 10 mm should be greater than or equal to 50 mm. The spacing for a total glass thickness of 15 mm should be greater or equal to 25 mm and the spacing should be 10 mm or greater for a total glass thickness of 20 mm. A mixture of sulfur hexafluoride and air is used for the gas having a lower speed of sound than air while helium is used as a gas having a higher sonic speed than air.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
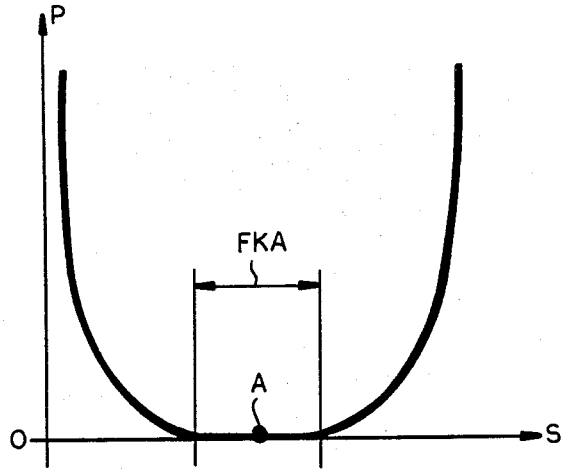
FIG. 1 shows the spring characteristic for the resilient means of a window structure of the present invention.

FIG. 1 shows, in a standard plot, the spring force characteristic FK of a resilient means used for holding a movable pane in a window structure according to the invention. The displacement of the pane is represented as s along the abscissa while the force applied by the resilient means to the pane is represented along the ordinate at P.

With this characteristic, there is a horizontal portion FKA having a center point A which corresponds to the working point.

With small displacements of the window pane, corresponding to shifts of the working point A along the horizontal portion FKA, the resistance is practically negligible. With greater displacements, however, the resistance increases sharply in each direction. In the embodiment shown when the displacement is about 8% of the interpane distance, the spring force P sharply increases and at about 12% displacement further deformation is scarcely possible.

Figure 2:
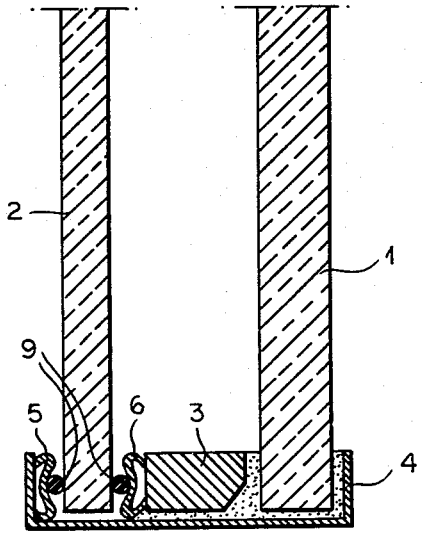
FIG. 2 is a vertical section through a portion of such a unit.

FIG. 2 shows an embodiment wherein the spacer frame 3, which is bonded to the stationary glass pane 1, is received together with an edge zone of this pane in a retaining profile frame 4 which extends entirely around the panes. The spring means are constituted by two leaf spring strips 5 and 6 which bulge in cross section and have convex sides bearing upon the opposite surfaces of the movable pane 2. The spring strips 5 and 6 otherwise bear against the frame members 3 and 4.

Figure 3:
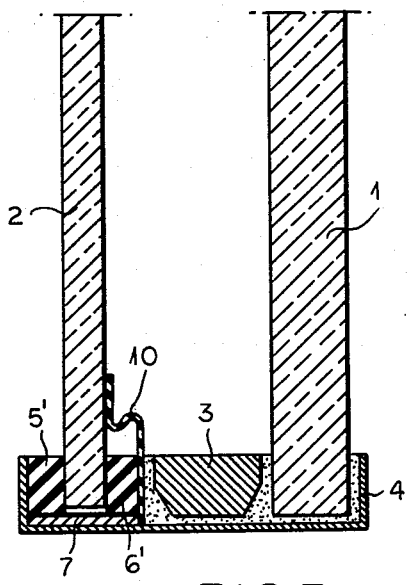
FIG. 3 is a view similar to FIG. 2 of a different embodiment.
Figure 4:
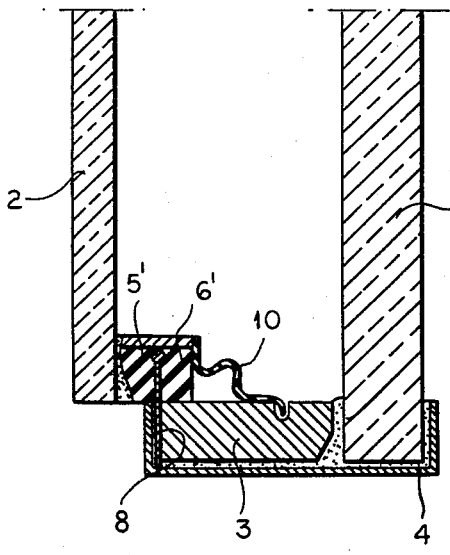
FIG. 4 is another partial section through a window unit of the invention.

In the embodiment of FIGS. 3 and 4 the resilient means is constituted by soft-elastic strips 5' and 6'.

In FIG. 3 these strips bear against opposite sides of the pane 2 and are composed of open pore soft-elastic and elastomeric materials which can be under prestress between the pane and the frames.

The strips 5' and 6' can rest against the support strip 7 which is composed of a low friction material and can be constituted as a sliding shoe or can be composed of a foil, e.g. of tetrafluorethylene.

In all of the embodiments, both of the panes can be movably mounted as described. In addition, the or both movable panes can be double or multiple glazed elements.

In the embodiment of FIG. 4, strips 5' and 6' are disposed on opposite sides of connecting web 8 received in the profile frame 4. In this case the resilient means is provided at the connection to the frame.

Figure 5:
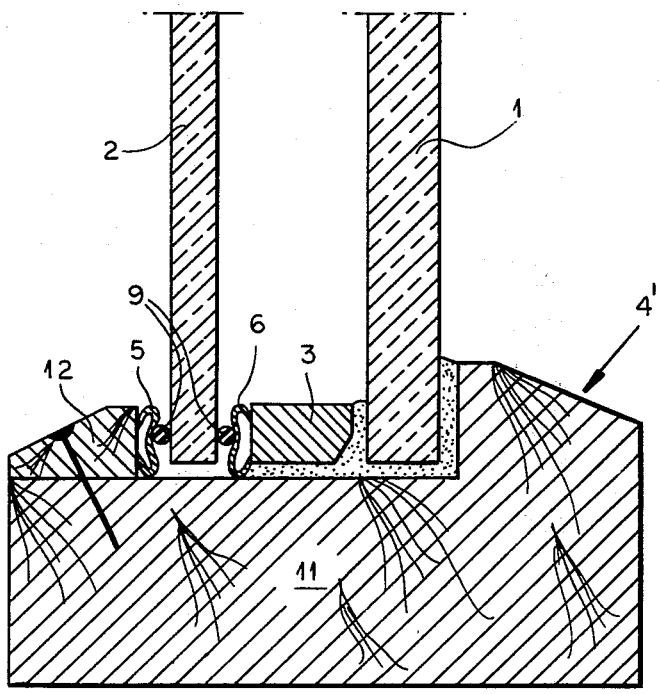
FIG. 5 is a view of the embodiment of FIG. 2 in another arrangement.

Additional sealing members can be provided and, in the embodiment of FIGS. 2 and 5, this sealing element can include a rubber (soft-elastic) strand 9 disposed between the spring strips 5, 6 and the pane 2. In the embodiments of FIGS. 3 and 4, the sealing means can be a soft-elastic foil strip 10 connected directly to the pane or to the resilient means and to the frame.

The frame 4' in the FIG. 5 embodiment is formed by the wood window frame 11 with the molding 12 holding the assembly in place.

Figure 6A:
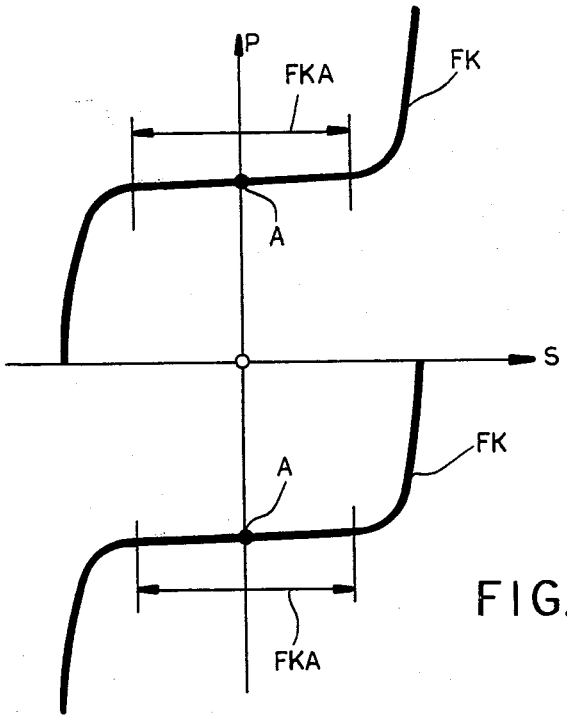
FIGS. 6*a* and 6*b* are graphs showing the individual spring characteristic for the spring elements of FIGS. 2 and 3 respectively.
Figure 6B:
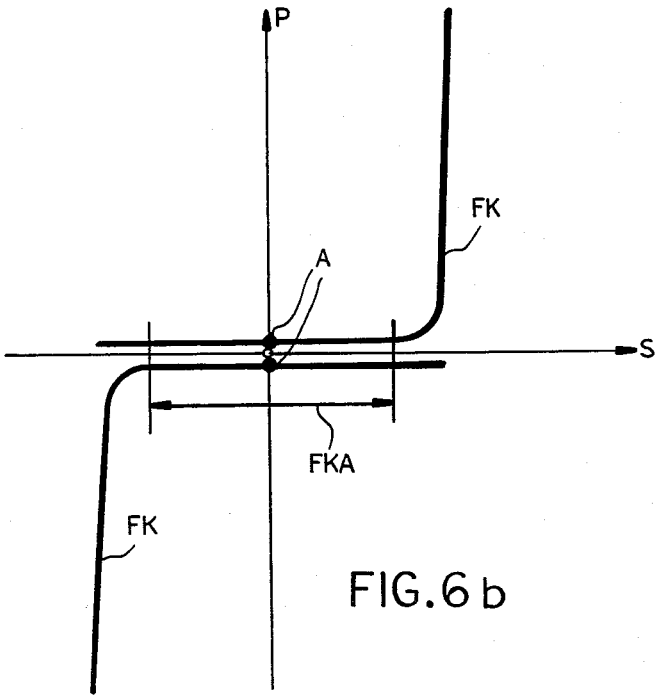

In FIGS. 6A and 6B, the spring characteristics of the individual spring elements of FIGS. 2 and 3, respectively, are shown. The positive force vector represents a force applied to the movable pane away from the stationary pane and the negative force vector application of force to the movable pane is the direction of the stationary pane. The displacement s is positive when the pane 2 is displaced toward the pane 1.

With these characteristics, the two spring elements are brought together so that the total spring characteristic is that of FIG. 1.

We claim:

1. An insulating window structure comprising:

an inner glass pane;

an outer glass pane;

a frame including means for spacing said panes apart, said frame extending around the periphery of said panes to define therein a gas-filled space; and resilient means for connecting at least one of said panes to said frame so as to enable the displacement of said one of said panes toward and away from the other of said panes, said resilient means having at least one leaf spring characteristic in which restoring force against said one of said panes is plotted along an ordinate and displacement of said one of said panes is plotted along the abscissa of a graph which has a horizontal portion centrally of said characteristic, said resilient means acting upon said one of said panes at a working point of said characteristic lying along said horizontal portion whereby force resisting displacement of said one of said panes remains substantially constant during displacement thereof against said resilient means.

2. The structure defined in claim 1 wherein said resilient means includes a pair of leaf spring strips bearing on opposite sides of said one of said panes and seated against said frame means.

3. The structure defined in claim 2 further comprising a sealing bead between each strip and said one of said panes.

4. The structure defined in claim 1 wherein said resilient means includes a pair of elastomeric strips connected to said one of said panes and a web received between said strips and connected to said frame means.

5. The structure defined in or claim 1 further comprising a sealing foil connected to said frame means for sealing said resilient means at least in part.

6. The structure defined in claim 3, or claim 4 wherein said space is filled with a gas having a speed of sound different from that of air.

* * * * *